US007168602B2

(12) United States Patent
Broehl

(10) Patent No.: US 7,168,602 B2
(45) Date of Patent: Jan. 30, 2007

(54) SHEET MATERIAL DISPENSER WITH TRANSFER SYSTEM AND METHOD

(75) Inventor: Joshua M. Broehl, Worthington, OH (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 10/972,269

(22) Filed: Oct. 25, 2004

(65) Prior Publication Data

US 2005/0051005 A1 Mar. 10, 2005

Related U.S. Application Data

(62) Division of application No. 09/736,419, filed on Dec. 15, 2000, now Pat. No. 6,826,985.

(51) Int. Cl.
*B26F 3/00* (2006.01)

(52) U.S. Cl. ..... 225/106; 225/16; 225/34; 83/338; 83/650; 83/949; 242/560.1; 242/564.2

(58) Field of Classification Search ..... 83/649, 83/650, 949, 436.15; 271/9.02, 9.03; 226/34, 226/35; 225/14, 106, 77, 16; 242/560.1, 242/564.2

See application file for complete search history.

(56) References Cited

U.S. PATENT DOCUMENTS

| | | | | |
|---|---|---|---|---|
| 43,692 | A * | 8/1864 | Hugunin | 492/23 |
| 119,235 | A | 9/1871 | McDonald | |
| 2,930,664 | A | 3/1960 | Liebisch | |
| 3,288,387 | A | 11/1966 | Craven | |
| 3,628,473 | A | 12/1971 | Bastian et al. | |
| 3,645,157 | A * | 2/1972 | Di Giulio et al. | 83/205 |
| 3,917,191 | A | 11/1975 | Graham, Jr. et al. | |
| 4,010,909 | A | 3/1977 | Bastian | |
| 4,067,509 | A | 1/1978 | Graham, Jr. et al. | |
| 4,148,442 | A | 4/1979 | Baumann et al. | |
| 4,165,138 | A | 8/1979 | Hedge et al. | |
| 4,203,562 | A | 5/1980 | DeLuca et al. | |
| 4,317,547 | A | 3/1982 | Graham, Jr. et al. | |
| 4,358,169 | A | 11/1982 | Filipowicz et al. | |
| 4,367,666 | A * | 1/1983 | Toth | 83/203 |
| 4,378,912 | A | 4/1983 | Perrin et al. | |
| 4,396,163 | A | 8/1983 | Graham, Jr. et al. | |
| 4,403,748 | A | 9/1983 | Cornell | |
| 4,487,375 | A | 12/1984 | Rasmussen et al. | |

(Continued)

*Primary Examiner*—Boyer D. Ashley
*Assistant Examiner*—Omar Flores-Sánchez
(74) *Attorney, Agent, or Firm*—Finnegan, Henderson, Farabow, Garrett & Dunner, LLP

(57) ABSTRACT

A dispenser having a transfer mechanism for transferring between a first source and a second source of sheet material, and a method for transferring between the first source and the second source. Dispensing is transferred from a first source to a second source upon an absence of sheet material from the first source. The transfer mechanism includes a transfer roller with a slot to receive a free end of sheet material from the second source. The transfer roller also includes a plurality of raised portions, the raised portions are free to rotate through a dispensing roller when there is an absence of sheet material from the first source. This rotation introduces the free end of sheet material from the second source to the dispensing roller, and allows dispensing from the second source. Afterwards, the transfer roller is set to receive sheet material from a new source of sheet material.

32 Claims, 10 Drawing Sheets

U.S. PATENT DOCUMENTS

| | | | | |
|---|---|---|---|---|
| 4,611,768 | A | | 9/1986 | Voss et al. |
| 4,694,714 | A | | 9/1987 | Focke et al. |
| 4,756,485 | A | | 7/1988 | Bastian et al. |
| 4,807,824 | A | | 2/1989 | Gains et al. |
| 4,846,412 | A | | 7/1989 | Morand |
| 4,856,724 | A | | 8/1989 | Jespersen |
| 4,944,466 | A | | 7/1990 | Jespersen |
| 5,129,294 | A | | 7/1992 | Boldrini et al. |
| 5,294,192 | A | | 3/1994 | Omdoll et al. |
| 5,302,167 | A | | 4/1994 | Kley et al. |
| 5,375,785 | A | | 12/1994 | Boone et al. |
| 5,400,982 | A | | 3/1995 | Collins |
| 5,526,973 | A | | 6/1996 | Boone et al. |
| 5,772,291 | A | | 6/1998 | Byrd et al. |
| 5,924,617 | A | | 7/1999 | LaCount et al. |
| 5,979,822 | A | | 11/1999 | Morand et al. |
| 6,032,898 | A | * | 3/2000 | LaCount et al. ..... 242/564.2 |
| 6,145,779 | A | | 11/2000 | Johnson et al. |
| 6,354,533 | B1 | | 3/2002 | Jespersen |
| 6,460,798 | B1 | | 10/2002 | Haen et al. |

* cited by examiner

SHEET MATERIAL DISPENSER WITH TRANSFER SYSTEM AND METHOD

This application is a divisional application of U.S. application Ser. No. 09/736,419, filed Dec. 15, 2000, U.S. Pat. No. 6,826,985 which is incorporated herein by reference.

DESCRIPTION OF THE INVENTION

Field of the Invention

The present invention relates to sheet material dispensers in general. More particularly, the present invention relates to sheet material dispensers capable of transferring dispensing from a first mode wherein sheet material is dispensed from a first sheet material supply to a second mode wherein sheet material is dispensed from a second sheet material supply, and a method of transfer.

BACKGROUND OF THE INVENTION

Sheet material dispensers are designed to dispense sheet material from various sources including folded sheet material and rolled sheet material. Each type of sheet material source requires a different means of loading and dispensing the sheet material. As a result, each source creates unique refilling problems for maintenance personnel.

Folded sheet material dispensers contain separate sheets of folded sheet material that are dispensed through an opening. Although most of these types of dispensers are relatively simple, there are drawbacks associated with using folded sheet material because this type of sheet material can be relatively expensive and occupy a rather large volume. In addition, dispensers containing folded sheet material generally need to be filled more often than other dispensers because they permit dispensing of multiple folded sheets simultaneously.

The most common type of sheet dispensers have sheet material wound on rolls. These dispensers have several different means of dispensing paper. The sheets can be removed by either pulling on a free end of a sheet or actuating a lever to advance the sheet. To increase sheet material supply, many roll dispensers are capable of holding two rolls of sheet material. These dispensers often require complicated transfer systems to switch dispensing from one roll to another. One type of transfer system uses a mechanism to detect tension in sheet material from a first roll. Once the tension is removed from the sheet material, indicating the first roll is empty, the mechanism pivots, thereby moving a free end of sheet material from the second roll of sheet material into engagement with a dispensing mechanism. Another type of transfer system involves a transfer mechanism including a complex follower arm, which follows the decreasing diameter of the first roll. Upon depletion of the first roll, the mechanism moves the free end of sheet material from the second roll into engagement with a dispensing mechanism. Both of these types of transfer systems, however, have complex transfer mechanisms and require a relatively long time to load the sheet material rolls.

As a result, maintenance personnel sometimes bypass the transfer system by only maintaining a single roll of sheet material in the dispenser. This has the effect of increasing the number of maintenance checks. This also sometimes leads to a new roll of sheet material being loaded in place of a used roll of sheet material, which is discarded while still having at least some usable sheet material thereon. Such practice can result in significant unnecessary waste of usable sheet material.

It is accordingly a primary object of the invention to provide a simple transfer system that requires minimum time to set up by maintenance personnel.

It is another object of the invention to provide a simple method of transferring between a first roll and a second roll of sheet material.

SUMMARY OF THE INVENTION

Accordingly, the present invention is directed to a sheet material dispenser with a transfer system and a method of transferring dispensing from a first mode where sheet material is dispensed from a first source of sheet material and to a second mode where sheet material is dispensed from a second source of sheet material.

To achieve these and other advantages and in accordance with the purpose of the invention, as embodied and broadly described herein, the invention includes a dispenser for dispensing sheet material. The dispenser includes a housing defining an interior for accommodating first and second sources of sheet material, and an outlet through which the sheet material is dispensed. A first rotatable roller is in the housing, and a portion of the sheet material is in contact with the first roller prior to being dispensed through the opening. A transfer mechanism is configured to transfer dispensing of sheet material from a first mode wherein sheet material is dispensed from the first source to a second mode wherein sheet material is dispensed from the second source. The transfer mechanism includes a second rotatable roller which has a slot passing completely through the second roller to retain a free end portion of the sheet material from the second source when the sheet material is dispensed in the first mode.

In another aspect, the first roller has at least one recessed portion, and the second roller has at least one raised portion aligned with the recessed portion. The recessed portion and the raised portion are configured such that when the sheet from the first source covers the recessed portion the transfer mechanism does not transfer dispensing from the first mode to the second mode.

In an additional aspect, the first roller has a first surface, and the second roller has a second surface. The second surface contacts sheet material on the first surface during at least dispensing in the first mode.

In a further aspect, the first surface has a higher coefficient of friction than a coefficient of friction of the second surface.

In yet another aspect, the first surface is formed from rubberized material.

In an additional aspect, the second surface is formed from plastic material.

In another aspect, the transfer mechanism includes at least one biasing element biasing the second roller toward the first roller.

In a further aspect, the dispenser includes a third roller. The third roller forms a nip with the first roller, and the sheet material passes through the nip during dispensing in the first and second modes.

In an additional aspect, the dispenser includes a driving mechanism configured to rotate at least one of the first and third rollers.

In a further aspect, the driving mechanism includes a manually driven element.

In another aspect, the driving mechanism includes an electric motor coupled to one of the first and third rollers.

In a further aspect, the dispenser includes a shield. The shield limits contact between the free end of sheet material from the second source and the first roller before the transfer mechanism transfers dispensing to the second mode.

In yet another aspect, the transfer mechanism is configured to transfer dispensing from the first mode to the second mode when sheet material from the first source is not between the first and second rollers.

In another aspect, the second roller is configured to rotate when sheet material from the first source departs from between the first and second rollers.

In an additional aspect, the third roller includes a cutter for cutting the sheet material.

In another aspect of the present invention, the dispenser includes a housing defining an interior for accommodating first and second sources of sheet material, and an outlet through which the sheet material is dispensed. A first rotatable roller in the housing has at least one recessed portion. A portion of the sheet material is in contact with the first roller prior to being dispensed through the opening. A transfer mechanism is configured to transfer dispensing of sheet material from a first mode wherein sheet material is dispensed from the first source to a second mode wherein sheet material is dispensed from the second source. The transfer mechanism includes a second rotatable roller having a retainer to retain a free end portion of sheet material from the second source when the sheet material is dispensed in the first mode. The second roller has at least one raised portion aligned with the recessed portion. The recessed portion and the raised portion are configured such that when sheet from said first source covers the recessed portion the transfer mechanism does not transfer dispensing from the first mode to the second mode.

In another aspect, the second roller has at least one second raised portion opposite the at least one first raised portion. The second raised portion is configured such that when sheet from the second source covers the recessed portion the second roller is oriented to receive a sheet from a new source.

In yet another aspect, the present invention includes a method of dispensing sheet material. The method includes providing a dispenser containing first and second sources of sheet material. The dispenser further includes a first rotatable roller having at least one recessed portion, and a second rotatable roller having at least one raised portion, the second roller having a retainer. The method includes dispensing sheet material from the first source by passing the sheet material between the first and second rollers, and retaining, in the retainer on the second roller, an end portion of sheet material from the second source. The method includes limiting rotation of the second roller by contacting the raised portion of the second roller against the sheet material between the first and second rollers. The second roller is placed in contact with the first roller when sheet material from the first source is no longer between the first and second rollers. The second roller rotates to feed sheet material from the second source onto the first roller to permit dispensing of sheet material from the second source.

In another aspect, the dispenser includes a third rotatable roller. The third roller forms a nip with the first roller, and the method includes passing sheet material through the nip.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate one embodiment of the invention and together with the description, serve to explain the principles of the invention. In the drawings.

DESCRIPTION OF THE PREFERRED EMBODIMENTS

Reference will now be made in detail to the present exemplary embodiments of the invention, examples of which are illustrated in the accompanying drawings. Wherever possible, the same reference numbers will be used throughout the drawings to refer to the same or like parts.

Figure 1:
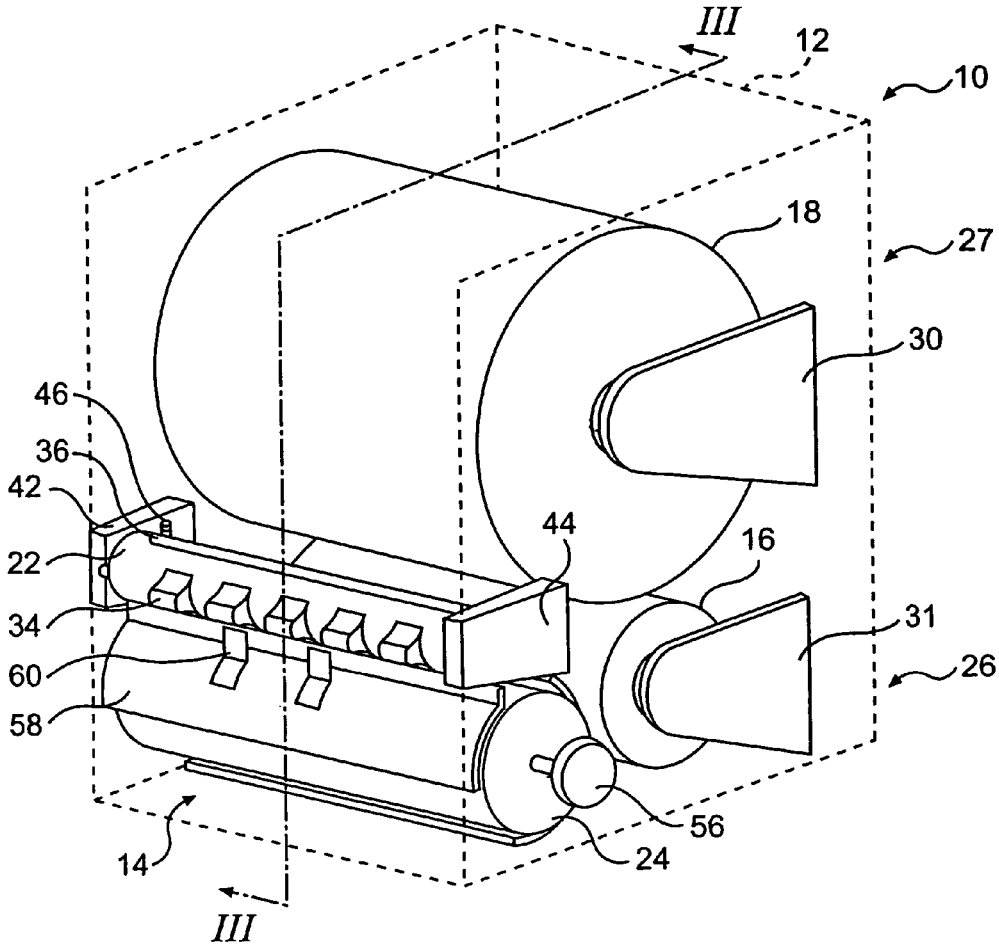
FIG. 1 is an isometric view of an embodiment of the invention.
Figure 2:
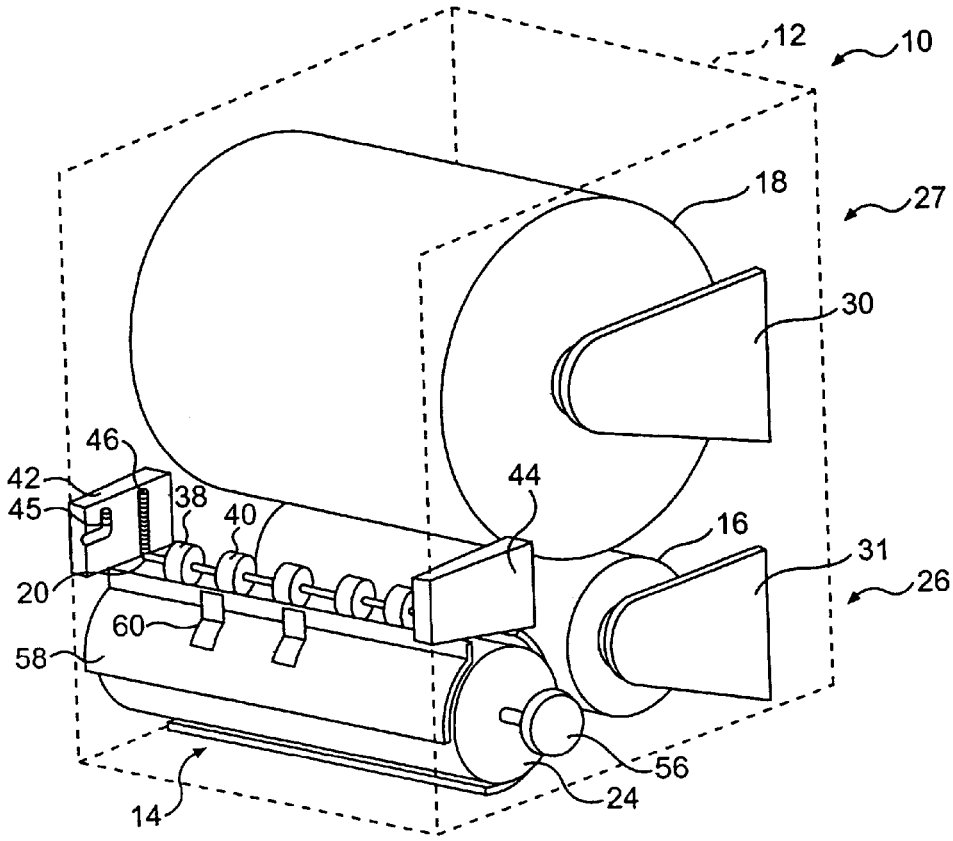
FIG. 2 is a view similar to FIG. 1 with a transfer roller removed to show a dispensing roller and a cutting roller.
Figure 3:
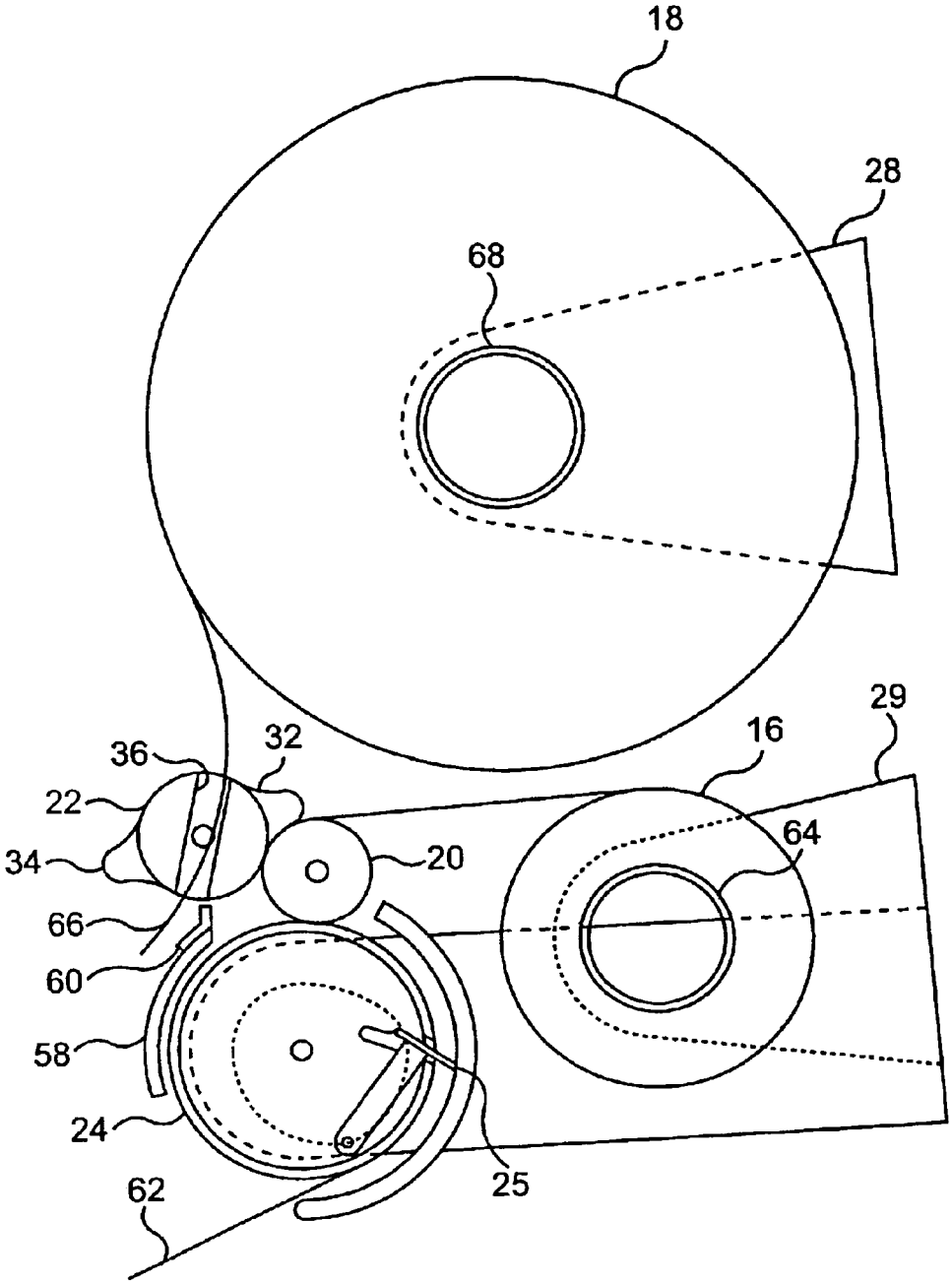
FIG. 3 is a schematic cross-section view taken along line III—III of FIG. 1 having the housing removed.

FIGS. 1–3 show an embodiment of a sheet material dispenser 10. The dispenser 10 includes a housing 12 having an outlet 14 and a cover (not shown). A first sheet material source 16 and a second sheet material source 18 are stored within the housing 12. A dispensing roller 20 and an optional cutting roller 24 cooperate to dispense sheet material from either the first source 16 or second source 18 through the outlet 14. A transfer roller 22 cooperates with the dispensing roller 20 to transfer dispensing from a first mode wherein sheet material is dispensed from the first source 16 to a second mode wherein sheet material is dispensed from to the second source 18, upon depletion of the first source 16.

Figure 4:
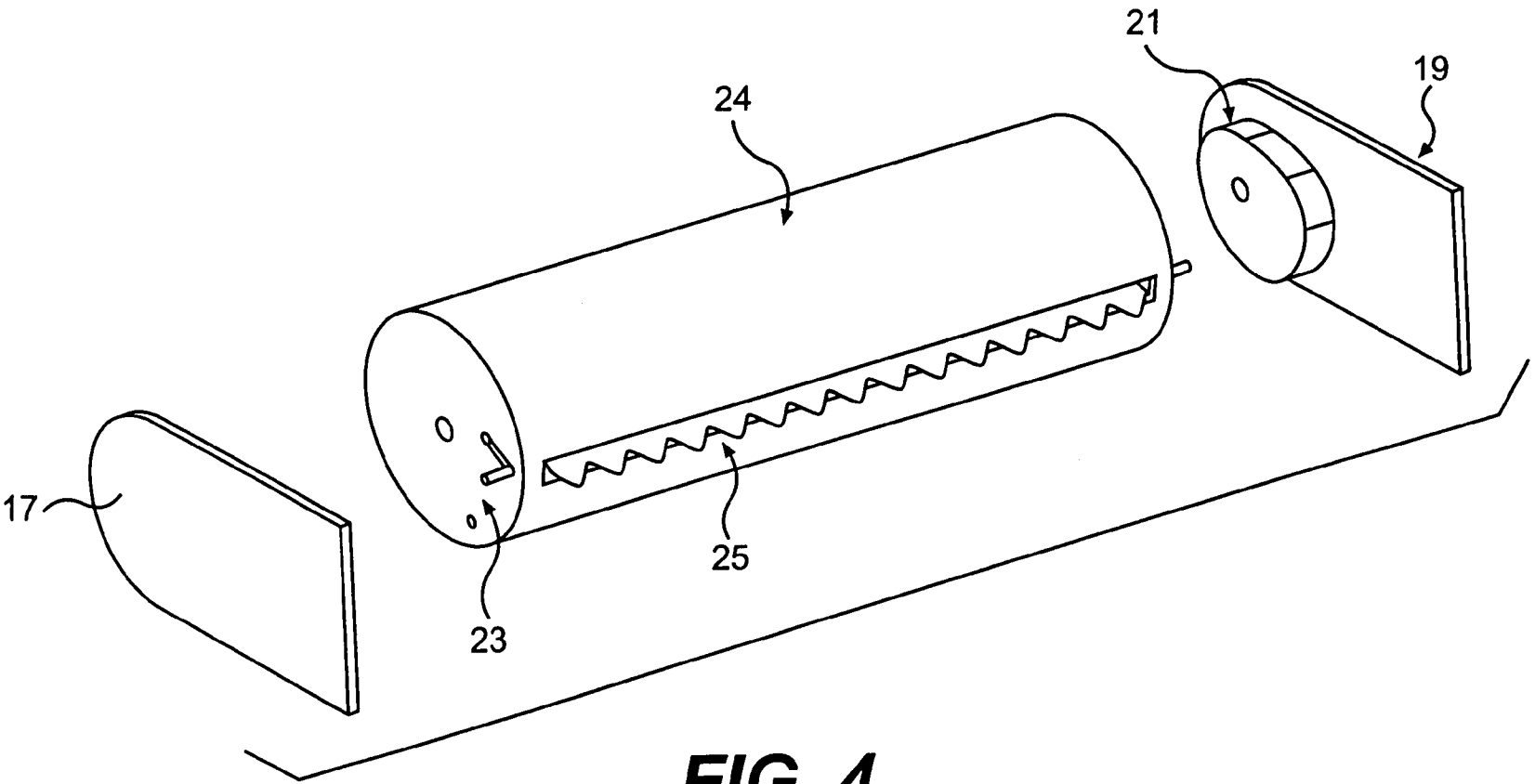
FIG. 4 is a exploded view of the cutting roller of FIG. 1.

In the preferred embodiment, the first source 16 and second source 18 are rolls of sheet material wound on cores 64 and 68, respectively. The sheet material can be paper towel, toilet paper, tissue paper, wrapping paper, or any other sheet material. In the embodiment shown in FIGS. 1–3, the sheet material is preferably formed into individual sheets as it passes over the cutting roller 24 and is cut by a cutter 25 thereon. FIG. 4 shows one arrangement for the cutter 25, and will be discussed below. The cutter 25 could also be arranged in a number of other places on the dispenser 10. Alternatively, the dispenser 10 lacks a cutter 25 and the sheet material includes spaced apart zones of weakness, such as perforation lines, that permit tearing off of separate sheets when they are dispensed.

The first source 16 is supported in a lower portion 26 of the housing 12 by spaced support members 29 and 31. Alternatively, the support members 29 and 31 can be eliminated, allowing the first source 16 to be supported on the floor in the lower portion 26. The second source 18 is rotatably supported by spaced support members 28 and 30. The support members 28 and 30 are mounted in an upper portion 27 of the housing 12.

The transfer roller 22 is located below the second source 18. The transfer roller 22, is rotatably supported by a left support block 42 and a right support block 44. The transfer roller 22 has a smooth outer surface, and preferably is made of plastic. Transfer roller 22 has a plurality of first raised portions 32, which are spaced from each other. Opposite each of the first raised portions 32 is one of a plurality of second raised portions 34. A slot 36 extends completely through the transfer roller 22 between the plurality of first raised portions 32 and the plurality of second raised portions 34. The slot 36 preferably has a width that is at least as large as the width of the sheet material of the second source 18 so that an end portion of the second source's sheet material can be retained in the slot 36, as shown in FIG. 3, by passing therethrough. Although the slot 36 passing through the transfer roller 22 is preferred to releasably retain the end portion of sheet material, other retaining structure could be used.

Adjacent the transfer roller 22 is the dispensing roller 20. The dispensing roller 20 includes a plurality of spaced roller sections 38, wherein each roller section 38 has a surface 40 formed of rubber or some other material having a coefficient of friction greater than that of an outer surface of transfer roller 22. The roller sections 38 can be made from wood, plastic, or metal. Adjacent pairs of the roller sections 38 are spaced from one another. Each space between the roller sections 38 is aligned with (and at least as wide as) corresponding first and second raised portions 32 and 34. The dispensing roller 20 is rotatably supported by the left and right support blocks 42 and 44, and is biased against the cutting roller 24 by springs 46. Similarly, the transfer roller 22 is biased against the dispensing roller 20 by springs 45. Alternatively, the weight of the transfer roller 22 can be used to bias the transfer roller 22 against the dispensing roller 20, thereby eliminating the springs 45.

The cutting roller 24 is rotatably supported in the housing 12 in any desireable manner, such as shown in FIG. 4. In the preferred embodiment, the cutting roller is supported by support arms 17 and 19. A cutter 25 is provided on the cutter roller 24 to cut sheet material into sheet segments as sheet material is dispensed. Support arm 19 includes a cam plate 21. The cutter 25 is attached to a cam follower 23 which follows the surface of the cam plate 21. As the cutting roller 24 rotates, the cutter 25 is extended and retracted as the cam follower 23 moves around the cam plate 21.

In the first embodiment, the cutting roller 24 is rotated as the sheet is pulled from the dispenser, as it is preferred that the driving force for activation of the mechanism is provided by the tension exerted on the sheet as the user draws it from the dispenser. Dispensers so configured are usually referred to as "touchless". An optional driving mechanism 56 is provided to rotate the cutting roller 24. In the embodiment of FIGS. 1–3, the driving mechanism 56 is a rotatable knob, which in touchless configurations would serve as an emergency feed. Alternatively, the driving mechanism could be a push lever, or an electric motor, which will be described below.

A shield 58 is arranged to prevent sheet material from the second source 18 from coming into contact with the cutting roller 24 before the transfer roller 22 transfers dispensing to a mode wherein sheet material is dispensed from the second source 18. Mounted to the shield 58 are a plurality of fingers 60, which also assist in preventing sheet material from the second source 18 from contacting the cutting roller 24 before the transfer process is activated.

To load the dispenser 10, an individual first opens the cover to expose the lower and upper portions 26, 27. The first source 16 is placed in the lower portion 26 of the housing 12. A free end 62 of the sheet material of the first supply source 16 is placed over the rubberized surfaces 40 of the dispensing roller 20, and then fed into the nip between the dispensing roller 20 and the cutting roller 24. The driving mechanism 56 can be activated to advance the free end through the outlet 14 of the housing 12. Then, the second source 18 is placed in the left and right support brackets 28, 30. A free end of sheet material 66 from the second source 18 is unwound and passed through the slot 36 of the transfer roller 22. A few inches of the free end of sheet material 66 preferably extends beyond the slot 36. Finally, the cover is closed, and the dispenser 10 is ready for use.

If the dispenser 10 had been loaded previously, then reloading has additional steps. After the cover is initially opened, the second source 18 is removed from the support brackets 28, 30. The empty core 64 from the first source 16 can then be removed. Then, the second source 18 can be placed in the lower portion 26 of the housing 12, essentially replacing the first source 16. A new second source 18 can be loaded as described above.

The sheet material could be dispensed from the dispenser 10 in any known manner. For example, a user could remove sheet material from the dispenser 10 in a "touchless" manner by merely pulling an end portion of sheet material that extends from the dispenser outlet 14, or by actuating a proximity sensor that interacts with a dispensing motor for rotating the dispensing and/or cutting rollers 20 and 24. In addition, the user is also preferably able to dispense sheet material by actuating a manually operated driving mechanism, such as the driving mechanism 56.

Figure 5:
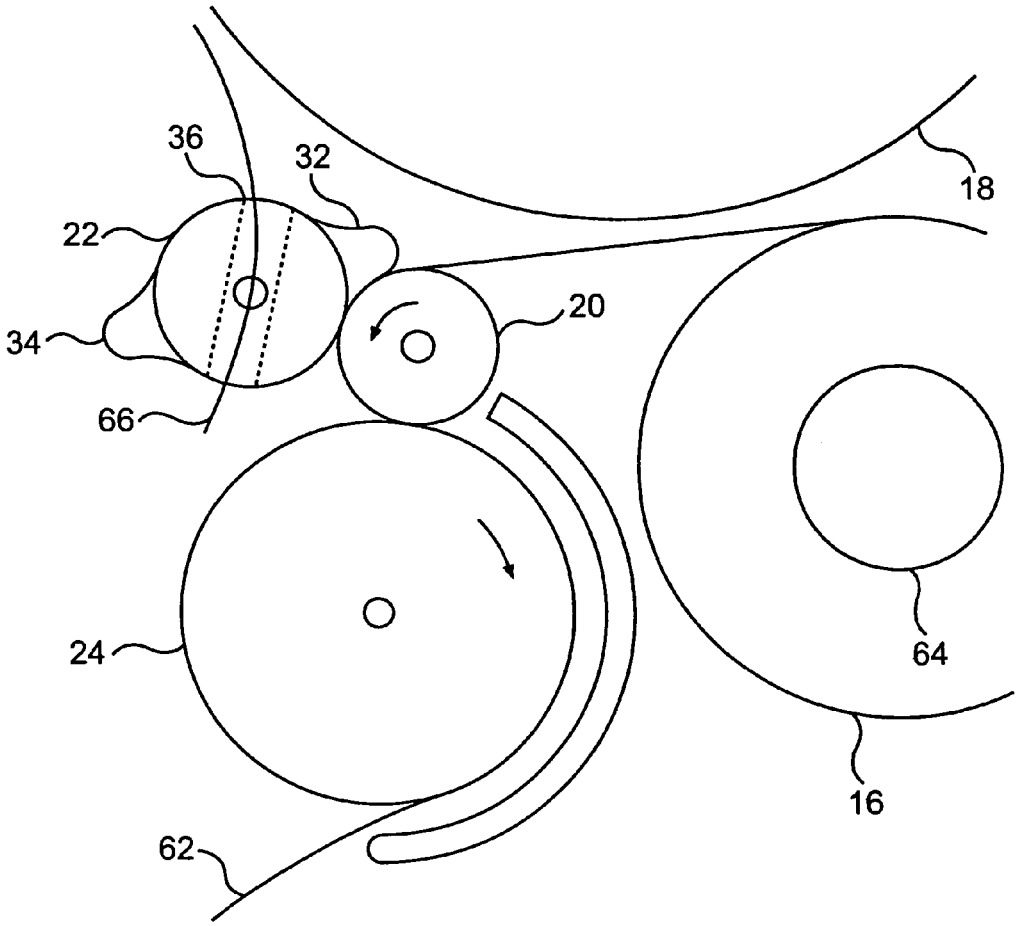
FIG. 5 is a detailed view of a portion of FIG. 3 showing dispensing from a first source.

The process of transferring dispensing modes between dispensing from the first source 16 and dispensing from the second source 18 is shown in FIGS. 5–8. FIG. 5 shows the dispenser 10 operating in a first mode where sheet material is being dispensed from the first source 16. As the cutting roller 24 rotates, the dispensing roller 20 rotates and sheet material is dispensed. The high coefficient of friction of the rubberized surfaces 40 causes the sheet material from the first source 16 to unwind. The transfer roller 22 is prevented from rotation by the plurality of first raised portions 32 coming in contact against the sheet material. The smooth surface 23 of the transfer roller 22 preferably does not hinder the dispensing of the sheet material. As long as sheet material from the first source 16 covers the spaces between the segments of the sections 38 of roller 20, the transfer roller 22 does not rotate during dispensing.

Figure 6:
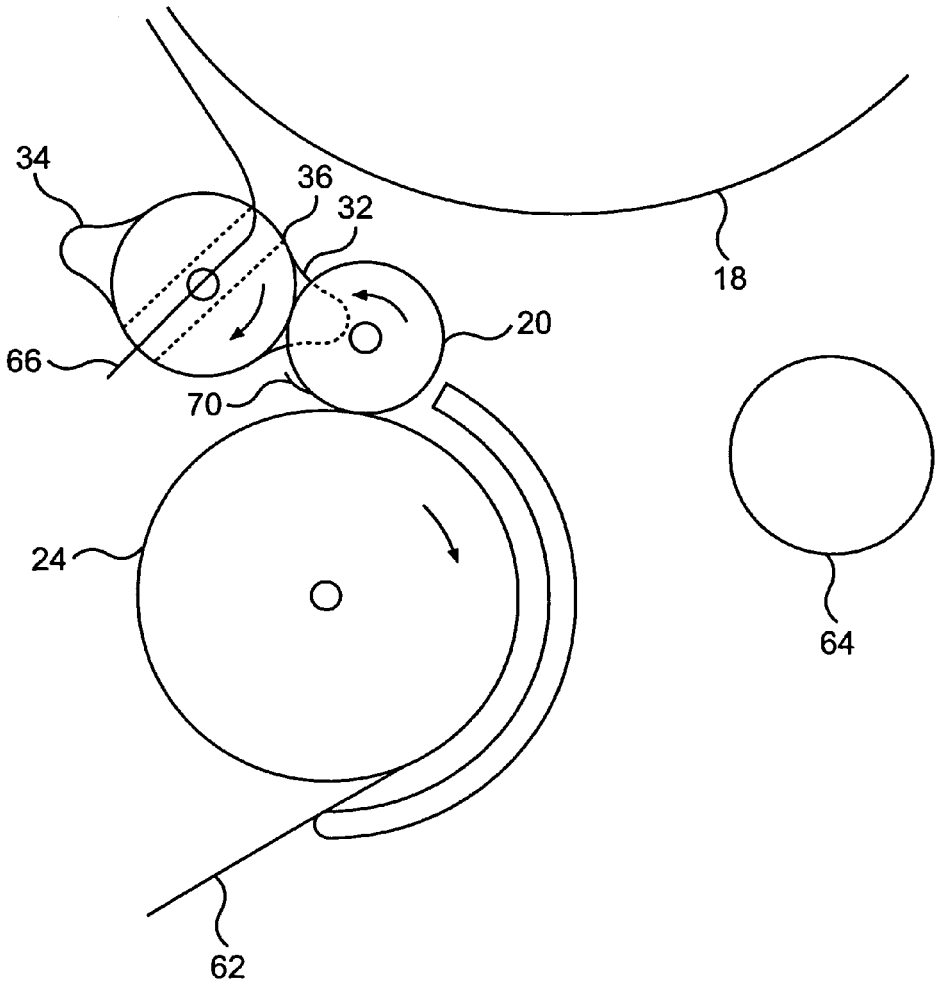
FIG. 6 is a view similar to FIG. 5 showing initial rotation of a transfer roller when sheet material from the first source becomes exhausted.
Figure 7:
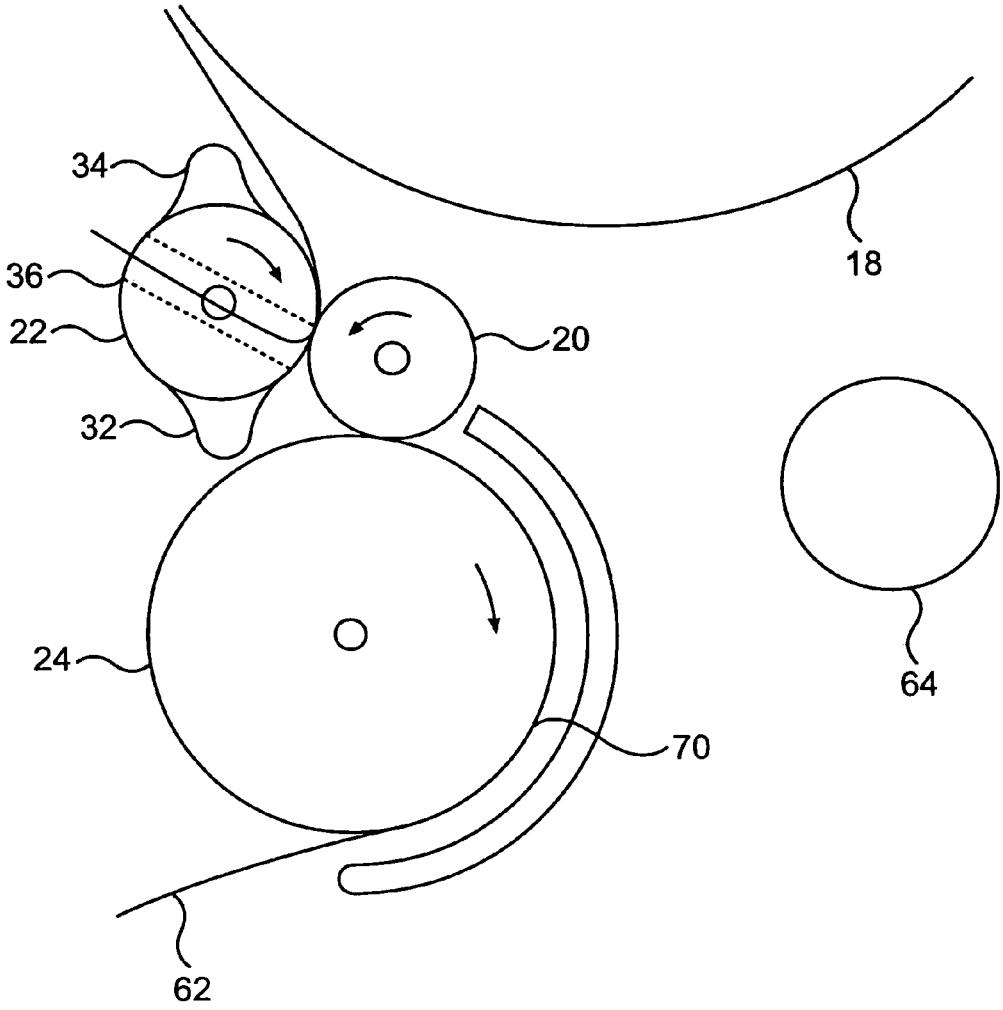
FIG. 7 is a view similar to FIG. 6 showing sheet material from a second source being fed onto a dispensing roller.
Figure 8:
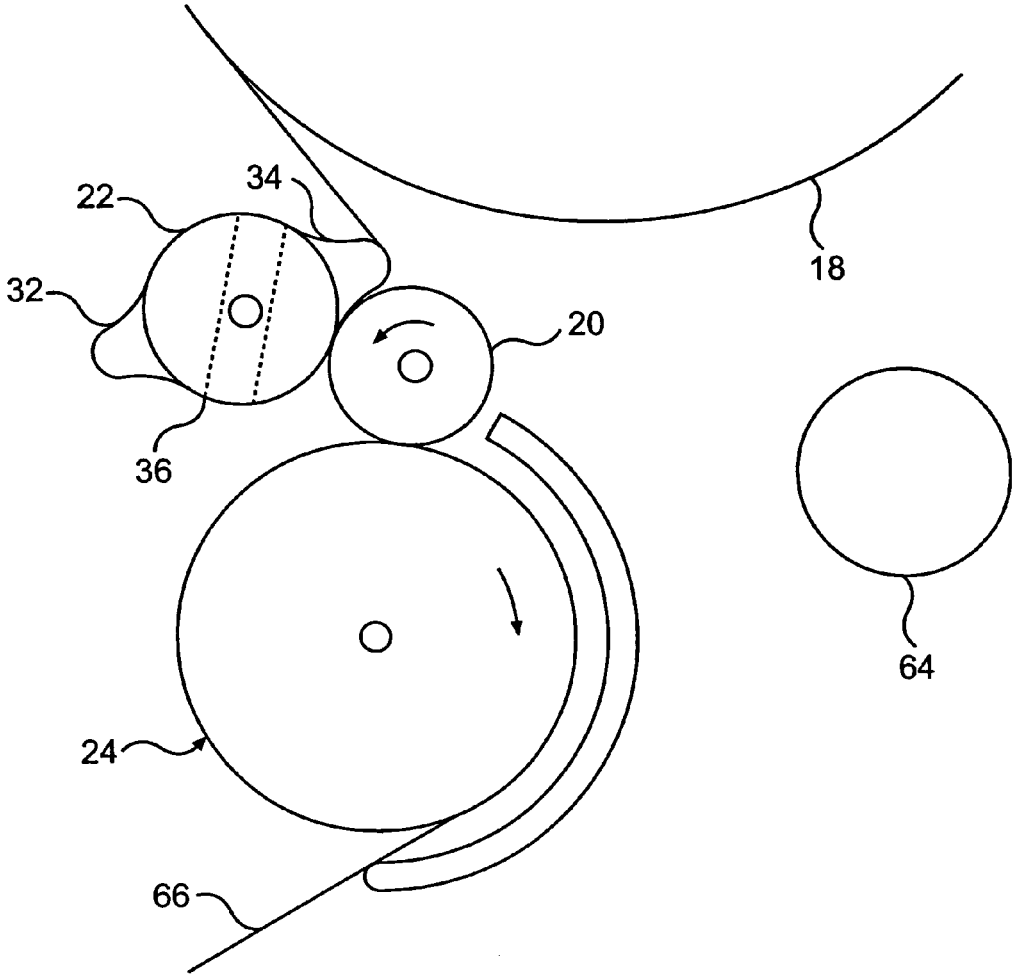
FIG. 8 is a view similar to FIG. 7 showing dispensing from the second source.

Once the sheet material from the first source 16 is depleted, a tail end of the sheet material 70 will pass through an area between the dispensing roller 20 and the plurality of first raised portions 32, as shown in FIG. 6, so that the transfer roller 22 contacts the dispensing roller 20. Without any sheet material between the dispensing roller 20 and the transfer roller 22, the rollers 20 and 22 become rotationally engaged and the rotation of the dispensing roller 20 causes the transfer roller 22 to rotate. As the transfer roller 22 rotates, the free end of sheet material 66 from the second source 18 contacts the dispensing roller 20. As seen in FIG. 7, the free end of sheet material 66 will be pulled from the slot 36 in the transfer roller 22. The rubberized surface 40 of the dispensing roller 20 grabs the free end of sheet material 66 and pulls the free end of sheet material 66 into the nip formed between the dispensing roller 20 and the cutting roller 24. The plurality of second raised surfaces 34 then contact the sheet material on the dispensing roller 20, thereby preventing further rotation of the transfer roller 22. The dispenser 10 is now in the second mode of dispensing, as seen in FIG. 8, where the dispenser 10 is dispensing sheet from the second source 18. In this configuration, the transfer roller 22 is set up for the next source to be loaded.

The preferred embodiment of the invention has many advantages, including complete use of sheet material. The transfer roller preferably allows easy loading of sheet material, defeating the need of maintenance personnel to bypass the transfer system. Preferably, less maintenance checks will be required because of the transfer system. In addition, the dispenser will preferably be more economical to use because the entire sheet material from each source will be used.

Figure 9:
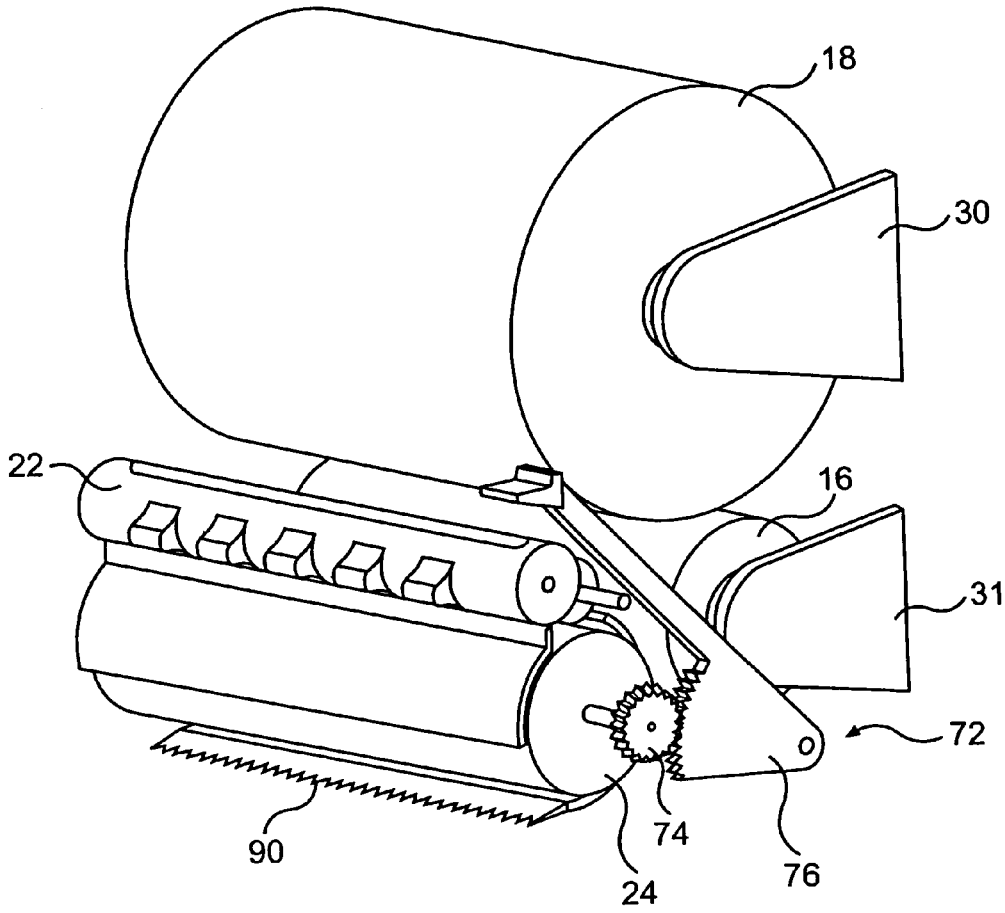
FIG. 9 is an isometric view of a second embodiment of the invention including a lever actuating system.

In a second embodiment of the invention, as seen in FIG. 9, the knob roller of the driving mechanism 56 is replaced with a lever actuation device 72. The lever actuation device 72 includes a toothed wheel 74 and a pivot arm 76. The toothed wheel 74 is coupled to the cutting roller 24. The pivot arm 74 can be attached to the housing (not shown) and engages the toothed wheel 74 to rotate the cutting roller 24. The lever actuation device 72 would serve as an emergency feed when the dispenser is configured as a "touchless" dispenser.

A tear bar 90 is provided to allow a user to tear off a sheet from the roll of sheet material. The tear bar 90 can be arranged in several different orientations at or near the opening of the housing (not shown). In addition the cutting roller 24 can be replaced with any suitable tensioning roller when the tear bar is provided.

Figure 10:
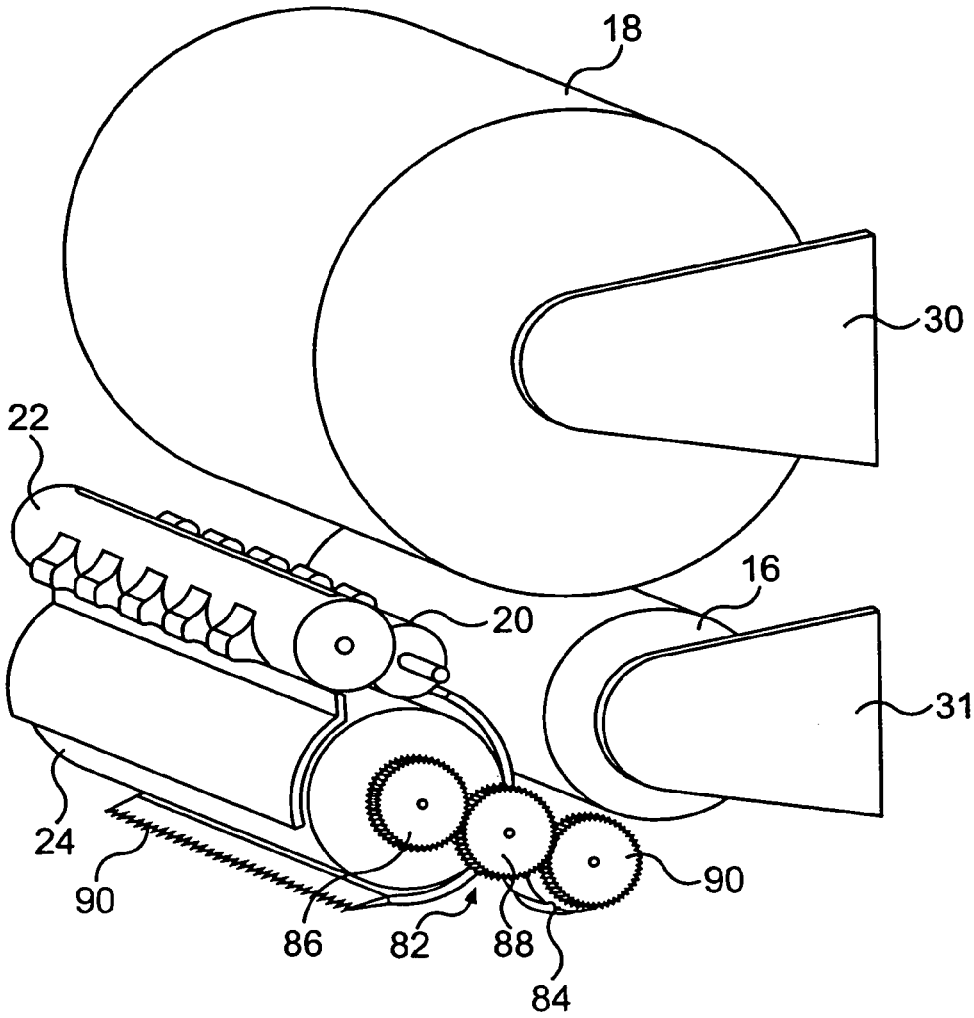
FIG. 10 is an isometric view of a third embodiment of the invention including a motor driven system.

In a third embodiment of the invention, as seen in FIG. 10, the knob roller of the driving mechanism 56 is replaced with a motor activation device 80. The motor activation device includes a gear train 82 and motor 84. The gear train includes a first gear 86, a second gear 88, and a drive gear 90. The drive gear 90 is coupled to the motor 84 and engages the second gear 88. The second gear 88 engages the first gear 86, which is coupled to the cutting roller 24. The motor 84 is activated by the user by any known switch, such as a push button (not shown). In a preferred embodiment, the motor is activated by a proximity sensor, thus providing "touchless" dispensing. The motor rotates the drive gear 90, which in turn rotates the second gear 88, which in turn rotates the first gear 86, which in turn causes the cutting roller 24 to rotate. In addition, FIG. 10 shows a tear bar 90 which serves the same purpose as described above.

Other embodiments of the invention will be apparent to those skilled in the art from consideration of the specification and practice of the invention disclosed herein. For example, a dispenser according to the invention could be constructed without a cutting roller. It is intended that the specification and examples be considered as exemplary only, with a true scope and spirit of the invention being indicated by the following claims.

The invention claimed is:

1. A dispenser for dispensing sheet material, said dispenser comprising:

a housing defining an interior for accommodating first and second sources of sheet material, and an outlet through which the sheet material is dispensed;

a first rotatable roller in the housing, a portion of the sheet material being in contact with the first roller prior to being dispensed through the opening; and a transfer mechanism configured to transfer dispensing of sheet material from a first mode wherein sheet material is dispensed from the first source to a second mode wherein sheet material is dispensed from the second source, said transfer mechanism including a second rotatable roller having a slot passing completely through the second roller to retain a free end portion of the sheet material from the second source when the sheet material is dispensed in the first mode.

2. The dispenser according to claim 1, wherein said first roller has at least one recessed portion, and wherein said second roller has at least one raised portion aligned with said recessed portion, said recessed portion and said raised portion being configured such that when sheet from said first source covers said recessed portion said transfer mechanism does not transfer dispensing from said first mode to said second mode.

3. The dispenser according to claim 1, wherein said first roller has a first surface, and said second roller has a second surface, said second surface contacting sheet material on said first surface during at least dispensing in the first mode.

4. The dispenser according to claim 3, wherein said first surface has a higher coefficient of friction than a coefficient of friction of said second surface.

5. The dispenser according to claim 4, wherein said first surface is formed from rubberized material.

6. The dispenser according to claim 4, wherein said second surface is formed from plastic material.

7. The dispenser according to claim 1, wherein the transfer mechanism further includes at least one biasing element biasing the second roller toward said first roller.

8. The dispenser according to claim 1, further comprising a third roller, forming a nip with said first roller, sheet material passing through the nip during dispensing in the first and second modes.

9. The dispenser according to claim 8, further comprising a biasing element biasing said first roller toward said third roller.

10. The dispenser according to claim 8, further comprising a driving mechanism configured to rotate at least one of said first and third rollers.

11. The dispenser according to claim 10, wherein the driving mechanism includes a manually driven element.

12. The dispenser according to claim 10, wherein the driving mechanism includes an electric motor coupled to one of said first and third rollers.

13. The dispenser according to claim 8, further comprising a shield, said shield limiting contact between said free end of sheet material from said second source and said first roller before said transfer mechanism transfers dispensing to said second mode.

14. The dispenser of claim 1, wherein the transfer mechanism is configured to transfer dispensing from said first mode to said second mode when sheet material from the first source is not between the first and second rollers.

15. The dispenser of claim 14, wherein said second roller is configured to rotate when sheet material from the first source is not between the first and second rollers.

16. The dispenser of claim 8, wherein the third roller includes a cutter for cutting the sheet material.

17. A dispenser for dispensing sheet material, said dispenser comprising:

a housing defining an interior for accommodating first and second sources of sheet material, and an outlet through which the sheet material is dispensed;

a first rotatable roller in the housing, said first roller having at least one recessed portion, a portion of the sheet material being in contact with the first roller prior to being dispensed through the opening; and a transfer mechanism configured to transfer dispensing of sheet material from a first mode wherein sheet material is dispensed from the first source to a second mode wherein sheet material is dispensed from the second source, said transfer mechanism including a second rotatable roller having a retainer to retain a free end portion of sheet material from the second source when the sheet material is dispensed in the first mode, said second roller having at least one first raised portion aligned with said recessed portion, said recessed portion and said raised portion being configured such that, when sheet from said first source covers said recessed portion, said transfer mechanism does not transfer dispensing from said first mode to said second mode.

18. The dispenser according to claim 17, wherein the second roller has at least one second raised portion opposite said at least one first raised portion, said second raised portion being configured such that when sheet from said second source covers said recessed portion said second roller is oriented to receive sheet from a new source.

19. The dispenser according to claim 18, wherein said first roller has a first surface, and said second roller has a second surface, said second surface contacting sheet material on said first surface during at least dispensing in the first mode.

20. The dispenser according to claim 19, wherein said first surface has a higher coefficient of friction than a coefficient of friction of said second surface.

21. The dispenser according to claim 20, wherein said first surface is formed from rubberized material.

22. The dispenser according to claim 20, wherein said second surface is formed from plastic material.

23. The dispenser according to claim 17, wherein the transfer mechanism further includes at least one biasing element biasing the second roller toward said first roller.

24. The dispenser according to claim 17, further comprising a third roller, said third roller forming a nip with said first roller, sheet material passing through the nip during dispensing in the first and second modes.

25. The dispenser according to claim 24, further comprising a driving mechanism configured to rotate at least one of said first and third rollers.

26. The dispenser according to claim 25, wherein the driving mechanism includes a manually driven element.

27. The dispenser according to claim 25, wherein the driving mechanism includes an electric motor coupled to one of said first and third rollers.

28. The dispenser according to claim 17, further comprising a shield, said shield limiting contact between said free end of sheet material from said second source and said first roller before said transfer mechanism transfers dispensing to said second mode.

29. The dispenser of claim 17, wherein the transfer mechanism is configured to transfer dispensing from said first mode to said second mode when sheet material from the first source is not between the first and second rollers.

30. The dispenser of claim 29, wherein said second roller is configured to rotate when sheet material from the first source is not between the first and second rollers.

31. The dispenser of claim 24, wherein the third roller includes a cutter for cutting the sheet material.

32. A dispenser for dispensing sheet material, said dispenser comprising:

a housing defining an interior for accommodating first and second sources of sheet material, and an outlet through which the sheet material is dispensed;

a first rotatable roller in the housing, the first rotatable roller having a plurality of recessed portions, a portion of the sheet material being in contact with the first rotatable roller prior to being dispensed through the opening; and a transfer mechanism configured to transfer dispensing of sheet material from a first mode wherein sheet material is dispensed from the first source to a second mode wherein sheet material is dispensed from the second source, said transfer mechanism comprising a second rotatable roller comprising a slot passing completely through the second rotatable roller to retain a free end portion of the sheet material from the second source when the sheet material is dispensed in the first mode, and a plurality of raised portions configured to be aligned with the recessed portions of the first rotatable roller.

* * * * *